US006431036B1

(12) United States Patent
Obermeier

(10) Patent No.: US 6,431,036 B1
(45) Date of Patent: Aug. 13, 2002

(54) SCREW ASSEMBLY FOR A STRIP-SHAPED SCREW MAGAZINE

(75) Inventor: Josef Obermeier, Peiting (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 09/963,154

(22) Filed: Sep. 25, 2001

(51) Int. Cl.[7] ..... B25B 23/04
(52) U.S. Cl. ..... 81/434; 81/57.37
(58) Field of Search ..... 81/434, 431, 435, 81/57.23, 57.37

(56) References Cited

U.S. PATENT DOCUMENTS 5,568,753 A * 10/1996 Habermehl et al. ..... 81/434
5,855,151 A * 1/1999 Habermehl ..... 81/434
6,123,244 A * 9/2000 Huang ..... 227/119

* cited by examiner

*Primary Examiner*—Joseph J. Hail, III
*Assistant Examiner*—David B. Thomas
(74) *Attorney, Agent, or Firm*—Sidley Austin Brown & Wood, LLP

(57) ABSTRACT

A screw assembly for setting screws, disposed in a strip-shaped screw magazine, is connected detachably with a screw driver, which has a basic body (7) with a control curve (8), and a guiding element (1). The screw assembly has a carriage (11), a transporting pawl (14) and a carrier (17). The guiding element (1) can be shifted counter to the force of a spring opposite to setting direction of the screw driver and has a carrier seat (3), which extends perpendicularly to the setting direction of the screw. The carriage (11) has a control element, which can interact with a control surface (8), and can be shifted against the force of a spring along the carrier seat (3). A transporting pawl (14), which can be connected positively with the screw magazine, is disposed pivotally at the carriage (11). The carrier (17) is disposed removably at the carrier seat (3) and has a transporting channel (33), which accommodates and guides the strip-shaped screw magazine.

10 Claims, 3 Drawing Sheets

SCREW ASSEMBLY FOR A STRIP-SHAPED SCREW MAGAZINE

FIELD OF INVENTION

The invention relates to a screw assembly device for a screw driver for driving screws from a strip shaped screw magazine into a workpiece.

BACKGROUND INFORMATION AND PRIOR ART

The German patent 24 44 457 discloses a screwing assembly for a screw driver, with screws, disposed in a strip-shaped magazine, can be driven into a workpiece. The screw assembly has a basic body, a guiding element, a carrier seat, a carriage, a transporting pawl and a carrier. The basic body is connected detachably with a housing of the screw assembly and the guiding element can be shifted relative to the housing of the screw assembly counter to the setting direction against the force of a spring element.

The guiding element is connected as a unit with the carrier seat, which extends perpendicularly to a setting direction of the screws and accommodates and guides the carriage. The carriage has a control element, which interacts with a control curve, disposed at the basic body. The carriage can be shifted against the force of a spring along the carrier seat in a direction opposite from the guiding element and perpendicularly to the setting direction. A pivotal transporting pawl, which is positively connected with the screw magazine, is disposed at the carriage. The carrier is fastened detachably at the carrier seat and has a transporting channel, which extends perpendicularly to the setting direction of the screws and accommodates as well as guides the strip-shaped screw magazine. The carrier is constructed essentially U-shaped and, at a free end region facing opposite to the setting direction, has two mutually opposite radial expansions, which extend over the whole length of the carrier and accommodate as well as guide the screw heads.

This known carrier is located at an end region end in the setting direction. Therefore, in the transporting channel, only screws can be accommodated, the length of which does not exceed the height of the transporting channel. The possibilities of using this known screwing device is therefore limited significantly, since screws, the length of which exceeds the height of the carrier, cannot be used. In addition, the removal of a strip-shaped screw magazine, which is inserted in the screw assembly, in a direction facing away from the guiding element, is associated with difficulties, since the transporting pawl, which is not accessible from the outside, interacts in the carriage of the screw assembly positively with the strip of the screw magazine.

OBJECT OF THE INVENTION

It is an object of the invention to create a screw assembly for a screwing device, the carrier of which can be used firmly with the transport seat and with which screws can be processed, which are longer than the height of the guiding channel in the carrier, measured parallel to the setting direction. In addition, it is possible to eliminate the positive connection between the transporting pawl and the strip-shaped screw magazine rapidly and easily, so that it becomes possible to remove the screw magazine from the guiding channel of the carrier in a direction away from the guiding element.

SUMMARY OF THE INVENTION

The inventive screw assembly has the advantage that the connection between the carrier and the carrier seat can be made or released rapidly with simple manipulations.

Preferably the fastening pawl is disposed at the carrier and can be shifted, for example, against the force of a spring plate essentially parallel to the setting direction into a release position. Advisably, the stop is at an end region of the carrier seat, spaced from the guiding element. A fastening surface of the fastening pawl grips behind this stop, when the carrier is slipped on to the carrier seat end and the user releases the fastening pawl, so that the latter can be pressed with the help of the spring plate into a fastening position.

In the region of the guiding element, the inventive screw assembly has a guiding channel, which extends perpendicularly to the setting direction, for the screw magazine. So that an essentially coaxial alignment of the transporting channel, which is disposed in the carrier, can be attained with respect to the guiding channel in the guiding element, the carrier must be centered appropriately with respect to the carrier seat. Advisably, at least one centering lug of the carrier, which protrudes positively into a centering guide of the guiding element, serves for the centering of the carrier at the guiding element.

Preferably an additional centering of the carrier at the carrier seat is attained with a centering pin of the carrier, which extends in the direction of the guiding element and engages an appropriately constructed centering region of the carrier seat. This centering region is at an end region of the carrier seat, spaced from the guiding element, and has a cross section, which extends parallel to the setting direction as well as perpendicularly to the longitudinal extent of the carrier seat and corresponds essentially to the cross-section of the centering pin.

The carriage of the transporting device transports a strip-shaped, screw magazine, which can be inserted into the transporting channel of the carrier, in the direction of the guiding element. For each setting process, the screwing device is pressed against a workpiece. At the same time, the guiding element is shifted in the direction of the basic body and the control surface, disposed at the carriage, acts together with the control curve, disposed at the basic body of the screwing device. At the same time, the carriage is shifted in a direction, away from the guiding element, along the carrier seat into a transporting position. After the setting operation, the screw device and screw assembly are lifted from the workpiece. At the same time, the control surface releases the control element once again and the carriage is shifted with the help of a spring back into its starting position. This shifting is achieved advisably with a pre-tensioned spring, which acts over a stud, protruding over the centering pin in the direction of the guiding element, together with a stop surface of the carriage.

A transporting pawl, which can be pivoted from a transporting position into a release position when a screw magazine is inserted into the transporting channel, protrudes into the clear width of the transporting channel of the carrier, when a screw of the screw magazine, closest to the guiding element, is pushed past the transporting pawl. As soon as the screw has passed by the transporting pawl, the latter pivots back into its transporting position. The transporting pawl is shifted for a brief moment from the transporting position into a release position by the next screw, which is to be set, also when the carriage is shifted along the carrier seat in a direction away from the guiding element. An automatic pivoting back of the transporting pawl from a release position into a transporting position is advantageously achieved owing to the fact that a catch of the transporting pawl is disposed between the stud and the stop surface. Accordingly, the catch, and also the stop surface of the carriage, act together with the spring, which is disposed in the carrier. This spring is compressed whenever the carriage is shifted into a loading position and/or the transporting pawl is pivoted into a release position.

A strip-shaped screw magazine, guided in the transporting channel of the carrier and connected positively with the transporting pawl, can be removed from the carrier counter to the transporting direction only if the positive connection of the screw magazine with the carrier is undone. This positive connection can be undone quickly and easily by a user, if the transporting arm of the transporting pawl in a direction extending parallel to the setting direction and perpendicularly to the longitudinal extent of the carrier seat, advisably protrudes at least partly through a lateral slot in the carrier into the transporting channel of the carrier. The inventive transporting pawl can readily be taken hold of by the user and can be pivoted with respect to the carriage into the release position, in which the transporting arm of the transporting pawl, for example, no longer protrudes into the transporting channel.

When setting or screwing screws into a workpiece, high setting rates can be achieved only if the contacting path of the screw assembly is as small as possible. For this reason, it is advisable to supply the screws to the guiding element as close as possible to the surface of the workpiece. So that this becomes possible, preferably the transporting channel of the carrier is disposed counter to the setting direction in front of the carrier seat.

A multi-purpose usability of the screwing device is achieved owing to the fact that a strip-shaped screw magazine with screws of large length can be used in the transporting channel. For this purpose, the transporting channel advantageously is constructed open in the setting direction.

Particularly if long screws are to be used, the tips of the screws protrude from the carrier. So that these tips cannot scratch of the surface of the workpiece, the distance of the transporting channel from a plane, extending perpendicularly to the setting direction counter to the setting direction, increases as the distance from the guiding element increases. For example the transporting channel is constructed partly curved, with the curved section adjoining a section which extends perpendicularly to the setting direction and adjoins the guiding element directly.

BRIEF DESCRIPTION OF THE DRAWINGS

The invention is described in greater detail by means of an described embodiment and drawings, in which.

BRIEF DESCRIPTION OF THE INVENTION

Figure 1:
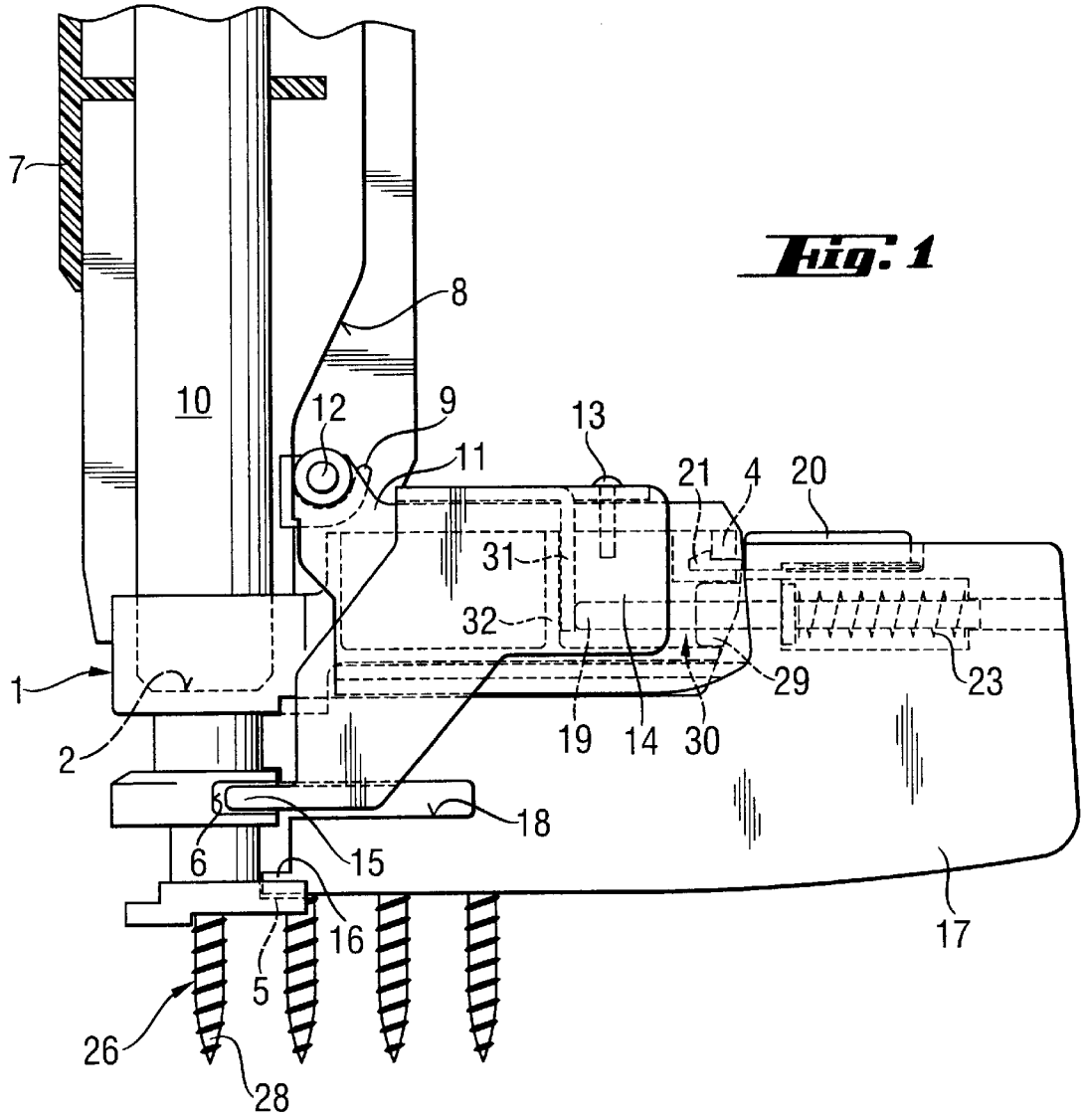
FIG. 1 is a side screw, partly in section, of a screw assembly for a screw driver embodying the present invention.
Figure 2:
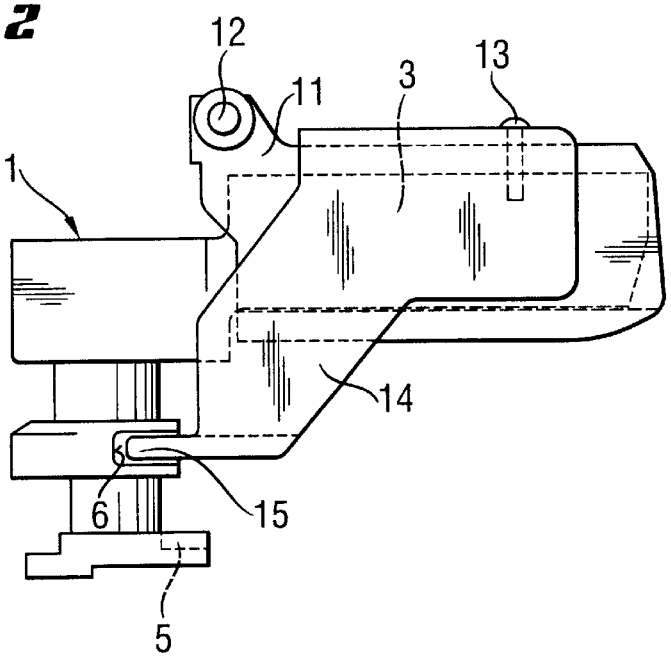
FIG. 2 is a side view of the guiding element, the carrier seat, the carriage and the transporting pawl of the screw assembly of FIG. 1.
Figure 3:
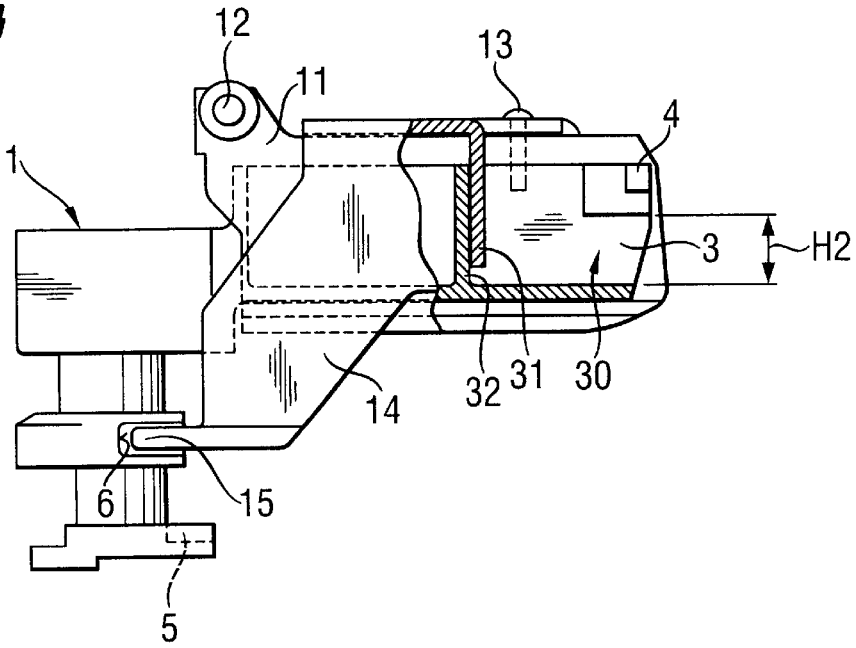
FIG. 3 is a side view of the guiding element, the carrier seat, the carriage and the transporting pawl of the screw assembly of FIG. 1.

The screw assembly, shown in FIGS. 1 to 5, can be connected with an end region in the setting direction, that is in the downward direction of a screw driver in FIG. 1, which is not shown, and comprises essentially a basic body 7, a guiding element 1, a carrier seat 3 protruding laterally from the guiding element 1, a carriage 11, a transporting pawl 14, a spring 23 and a carrier 17. The guiding element 1, protrudes counter to the setting direction partly into the basic body 7 of the screw driver and axially is connected firmly with a connecting sleeve 10. This connecting sleeve 10 axially holds the screw driver at the screwing assembly and can be shifted with respect to the screw assembly counter to the force of a spring, which is also not shown, counter to the setting direction. An accommodating borehole 2, matched to the external contour of the connecting sleeve 10, axially fixes the guiding element 1 at the connecting sleeve 10.

The carrier seat 3, which is connected as a unit with the guiding element 1, protrudes laterally from the guiding element 1 perpendicularly to the setting direction. The carriage 11, at which a transporting pawl 14 is located, can be shifted along this carrier seat 3. At an end region of the guiding element 1, the carriage 11 has a control element in the form of a rotatable roller 12. This roller 12 acts together with a control surface 8, located on the basic body 7 of the screw driver, when the screw driver is pressed against a work piece, not shown, and the guiding element 1 is shifted into the basic body 7. In the outlet position of the screw assembly, the roller 12 is in a seat region 9 of the basic body 7, which is formed open counter to the setting direction.

The transporting pawl 14 is disposed on the outside of the carriage 11 and can be pivoted with respect to the carriage 11 about a pivoting axis 13, which extends parallel to the setting direction. As shown particularly by FIG. 3, the transporting pawl 14 has a bent catch 31, which extends parallel to the setting direction in an interior space of the carrier seat 3. A side of this catch 31, facing the guiding element 1, bears against a stop surface 32 of the carrier seat 3. A stop 4 and a centering region 30 are at a free end region of the carrier seat 3, directed away from the guiding element 1.

Figure 4:
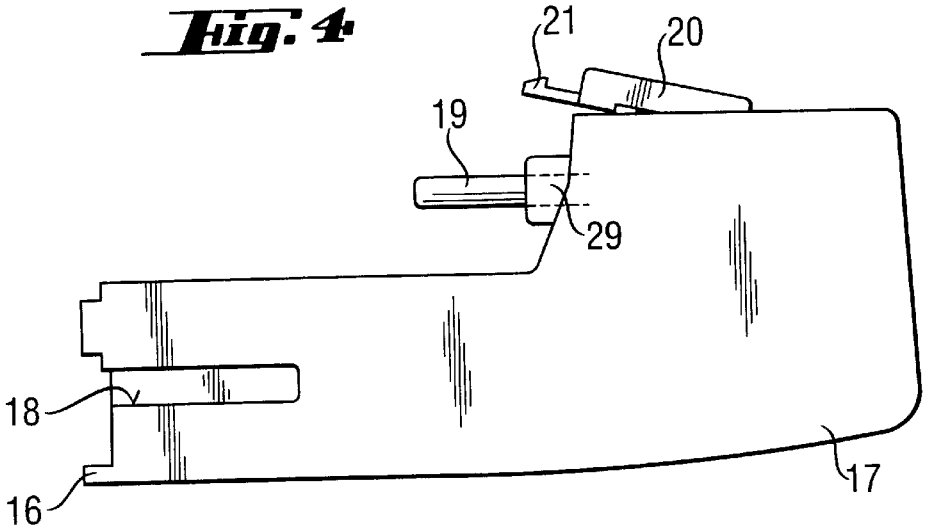
FIG. 4 is a side view of a carrier of the screw assembly of FIG. 1.
Figure 5:
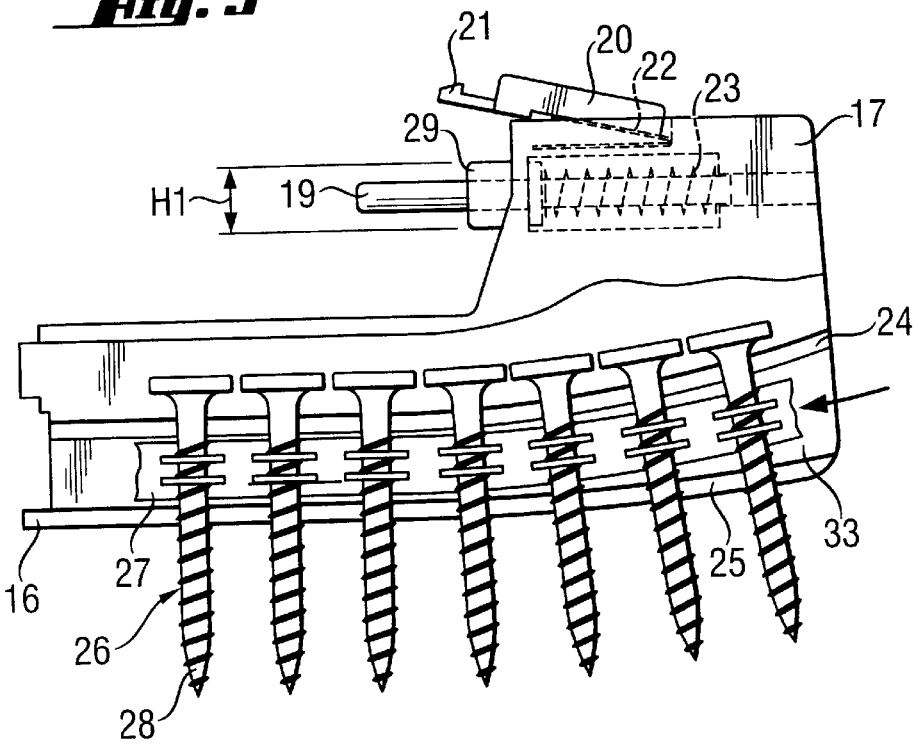
FIG. 5 is a side view of the carrier of the screw assembly of FIG. 1, shown partly in section.

The carrier 17, shown in FIGS. 4 and 5, has a transporting channel 33, which accommodates and guides a strip-shaped screw magazine 26. This screw magazine 26 holds a number of screws 28, which are detachably fastened at equal intervals to one another in a strip 27. The width of the strip 27 extends parallel to the setting direction and a thickness of the strip 27 extends perpendicularly to the setting direction. In the transporting channel 33, there is a first guiding cross member 24, as well as a second guiding cross member 25. The underside of the screw heads, facing in the setting direction, rests on the first guiding cross member 24 and the strip 27 is supported in the setting direction by the second guiding cross member 25.

A first region of the transporting channel 33, facing and adjacent to the guiding element 1, extends perpendicularly to the setting direction. A second region of the transporting channel 33, adjoining the first region, is constructed essentially curved, so that the distance of the transporting channel 33 from a plane, which extends perpendicularly to the setting direction, always increases as the distance from the guiding element 1 increases.

The carrier 17 can be slipped onto the carrier seat 3 and fixed to the latter. At least one centering lug 16, formed on the carrier 17, and a centering pin 29, also disposed at the carrier 17, center the carrier 17 with respect to the guiding element 1 and the carrier seat 3. The centering lug 16 is at an end region of the carrier 17, facing the guiding element 1, and can be connected positively with a correspondingly constructed centering guide 5 on the guiding element 1. The centering pin 29 protrudes into a centering region 30 of the carrier seat 3, which is matched to the cross-section of the centering pin 29, when the carrier 17 is slipped onto the carrier seat 3. A height H1 of the centering pin 29, measured parallel to the setting direction, corresponds essentially to a height H2 of the centering region 30, measured in the same direction.

On a side of the carrier 17, facing away from the setting direction, a fastening pawl 20 is secured and can be pivoted relative to the carrier 17 in a plane, extending parallel to the setting direction and parallel to the longitudinal extent of the carrier seat 3. A fastening hook 21 of the fastening pawl 20 can be connected positively with the stop surface 32 of the stop 4 of the carrier seat 3, when the carrier 17 is slipped onto the carrier seat 3 and the fastening hook 21 grips behind the stop 4. With the help of a spring plate 22, the fastening pawl 20 is pressed counter to the setting direction against the stop 4, so that the positive connection cannot become undone.

At the carrier 17, a stud 19 is disposed, arranged essentially coaxially to the centering pin 29 and protrudes over the latter in a direction facing the guiding element 1. The stud 19 can be shifted against the force of a spring 23 in a direction facing away from the guiding element 1 and perpendicularly to the setting direction. When the carrier 17 is fastened to the carrier seat 3, the stud 19 acts together with the catch 31 of the transporting pawl 14 and with the stop surface 32 of the carrier seat 3.

The carrier 17 has a laterally open slot 18, which is open at the end region facing the guiding element 2. A transporting arm 15 of the transporting pawl 14 protrudes through this lateral slot 18 and through a lateral opening 6 in the guiding element 1 and acts positively there, for example, with a screw 28 of the screw magazine 26. For each setting operation, for which the screw driven is pressed against a workpiece, the carriage 11 is shifted along the carrier seat 3 in a direction facing away from the guiding element 1. During this shifting, the transporting arm 15 is pivoted with respect to the screw magazine 26. At the same time, the transporting arm 15 is swiveled by a subsequent screw 28 of the screw magazine 26 from its transporting position into a release position until it has passed by this screw 28 and, with the help of the pretensioned spring 23, it is pivoted back once again into its transporting position in the carrier 17. After a setting operation has been accomplished, the screw driver is lifted from the workpiece. At the same time, the pre-tensioned spring 23 presses the carriage 11 back into its starting position. During this shifting of the carriage 11, the screw magazine 26 is transported in the transporting direction, that is, in the direction toward the guiding element 1, since the transporting arm 15 has assumed its transporting position once again before this shifting of the carriage 11 commences.

What is claimed is:

1. A screw assembly for a screw driver comprising a housing, for setting screws (28) arranged in a strip shaped screw magazines (26), the screw driver having a setting direction, a basic body (7) extending in the setting direction and a control surface (8) extending generally in the setting direction, said screw assembly comprising a guiding element (1), a carrier seat (3) extending laterally from and connected to said guiding element (1) and extending perpendicularly to the setting direction, a carriage (11) arranged to be shifted along said carrier seat (3), a transporting pawl (14) located on said carriage (11), a carrier (17) detachably securable on said carrier seat (3), said basic body (7) being detachable connected to said housing of the screw assembly, said guiding element (1) being movable counter to the force of a spring member relative to the housing of the screw assembly opposite to the setting direction and connected as a unit with said carrier seat (3), a control element (12) on said carriage engageably interacting with said control surface (8) and being displaceable along said carrier seat (3) against the force of a spring (23) in a direction away from said guiding element (1), said transporting pawl (14) being pivotally disposed on said carriage (11), said carrier (17) having a transporting channel (33) for receiving and guiding said strip shaped screw magazine (26) and extending at least partly perpendicular to the setting direction and wherein a detachable positive connection formed by a fastening pawl (20) and a stop (4) fastens said carrier (17) to said guiding element (1).

2. A screw assembly, as set forth in claim 1, wherein said fastening pawl (20) is located on said carrier (17) and said stop (4) on said carrier seat (3).

3. A screw assembly, as set forth in claim 1, wherein at least one centering lug (16) on said carrier (17) centers the carrier on said guiding element (1) and interacts positively with a centering guide (5) in said guiding element (1).

4. A screw assembly, as set forth in claim 1, wherein a centering pin (29) in said carrier (17) projects into a centering region (30) in said carrier seat (3) for centering said carrier (17) in said carrier seat (3).

5. A screw assembly, as set forth in claim 4, wherein a stud (19) displaceable against the force of said spring (23) in a direction away from said guiding element (1) interacts with a stop surface (32) of the said carriage (11) and protrudes over said centering pin (29) in the direction toward said guiding element (1).

6. A screw assembly, as set forth in claim 5, wherein a catch (31) of said transporting pawl (14) is positioned between said stud (19) and said stop surface (32).

7. A screw assembly, as set forth in claim 6, wherein at least one transporting arm (15) of said transporting pawl (14) projects through a lateral slot (18) in said carrier (17) into said transporting channel (33) of said carrier (17) in a direction extending parallel to the setting direction and perpendicular to the longitudinal extent of said carrier seat (3).

8. A screw assembly, as set forth in claim 7, wherein said transporting channel (33) is located opposite to the setting direction before said carrier seat (3).

9. A screw assembly, as set forth in claim 8, wherein said transporting channel (33) is formed open in the setting direction.

10. A screw assembly, as set forth in claim 9, wherein a direction of said transporting channel (33) from a plane extending perpendicularly to the setting direction increases counter to the setting direction as the distance of said transporting channel (33) increases from said guiding element (1).

* * * * *